US005449098A

United States Patent [19]

Offman

[11] Patent Number: 5,449,098

[45] Date of Patent: Sep. 12, 1995

[54] FLUID FLOW CONTROLLER FOR BOTTLE

[76] Inventor: Henoch M. A. Offman, 750 Forest Ave., Apt. 47F, Lakewood, N.J. 08701

[21] Appl. No.: 217,120

[22] Filed: Mar. 24, 1994

[51] Int. Cl.[6] ..... B67D 3/00

[52] U.S. Cl. ..... 222/481.5; 222/484

[58] Field of Search ..... 222/478, 479, 481–483, 222/484, 485, 464; 215/309

[56] References Cited

U.S. PATENT DOCUMENTS

| | | | |
|---|---|---|---|
| 3,173,566 | 3/1965 | Talbert | 215/309 |
| 3,319,842 | 5/1967 | Miller | 222/484 |
| 4,674,654 | 6/1987 | Fuji et al. | 222/478 |
| 4,802,610 | 2/1989 | Cheek et al. | 222/481.5 |
| 4,938,395 | 7/1990 | Jamieson | 222/478 |
| 4,967,922 | 11/1990 | Alder | 222/481 |
| 5,301,846 | 4/1994 | Schmitz | 222/481.5 |

*Primary Examiner*—Andres Kashnikow
*Assistant Examiner*—Philippe Derakshani
*Attorney, Agent, or Firm*—Ira M. Adler

[57] ABSTRACT

The invention relates to a bottle fluid flow controller inserted into a narrow necked bottle which contains a fluid, and when inverted, allows air to enter the bottle through a hole in the side of the bottle and flow through a reservoir, thence up a tube and combines with the air which is on top of the surface of the fluid. The arrangement results in a steady, smooth flow of fluid from an inverted bottle.

1 Claim, 6 Drawing Sheets

FLUID FLOW CONTROLLER FOR BOTTLE

BACKGROUND—FIELD OF INVENTION

The invention relates to an apparatus which is attached inside a narrow necked bottle, such as one used for the storage of soft drinks. Narrow necked bottles are often used to limit the discharge of gas from a soft drink. With the use of the present invention, when the bottle is inverted the fluid inside the bottle flows out of the bottle smoothly.

BACKGROUND & DESCRIPTION OF PRIOR ART

Presently when a narrow necked bottle is inverted, fluid flows out irregularly. This is a result of air alternately entering the bottle and fluid exiting the bottle at the constricted neck of the bottle. This results in an irregular and uneven flow. The present invention provides a means for air to enter the bottle through an opening in the side of he bottle, thereby avoiding the inward flow of the air interfering with exiting fluid flow from the neck of the bottle. This provides for a smooth flow of fluid from the bottle. An internal reservoir avoids leakage of the fluid when the bottle is inverted.

No prior inventions have combined the elements of a reservoir in the neck of a bottle with a venting hole in the side of the neck. In Jamieson, U.S. Pat. No. 4,938,395, a vent hole is placed in the side of a bottle. Alder, U.S. Pat. No. 4,967,922 discloses a bleeder valve mechanism inside a bottle to control fluid flow. Talbert, U.S. Pat. No. 3,173,566 discloses a drinking straw mechanism to control flow, combined with a side vent.

OBJECT & ADVANTAGES

The object of the invention is to facilitate the smooth flow of fluid from an inverted narrow neck bottle.

DRAWING FIGURES

SPECIFICATIONS

Figure 1:
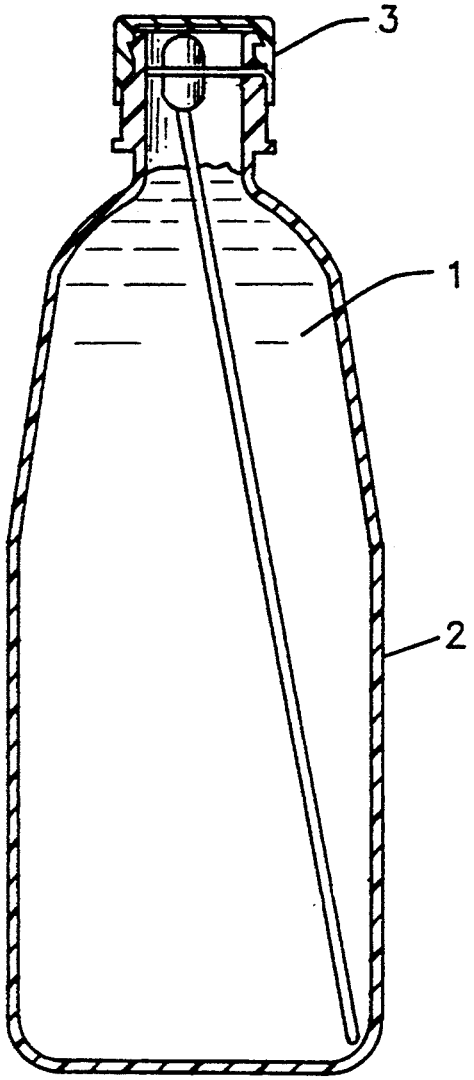
FIG. 1 is a cross-section of a closed bottle in an upright position, containing the bottle flow controller, and the cap for sealing the top of the bottle and inlet hole.

Typically in the use of the invention, as in FIG. 1, a bottle, 2, in an upright position is filled with a fluid, 1, and closed with a cap, 3. When the bottle is inverted, with the cap, 3, removed as in FIG. 2, only the fluid previously in the tube flows down the tube, 10, into the reservoir, 7. The fluid fills the top part of the reservoir, 23, until its level reaches the bottom of the air inlet hole, 12, which is inserted into the middle of the side of the reservoir. In use, the air inlet hole, 12, is pointed upward to avoid leakage from the reservoir, 7.

Figure 4:
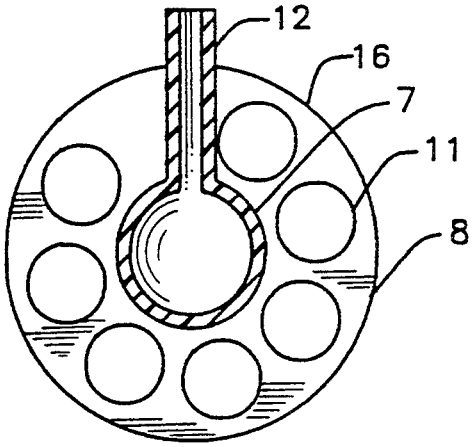
FIG. 4 is a section of the bottle flow controller perpendicular to the longitudinal axis of the reservoir.
Figure 5:
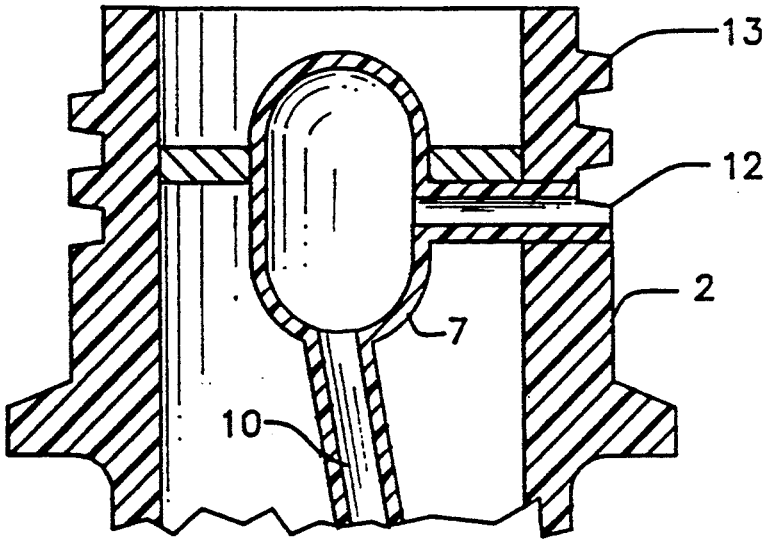
FIG. 5 is a section of the bottle flow controller parallel to the longitudinal axis of the reservoir, placed into the neck of the bottle.

The reservoir, 7, is affixed to the inside opening of a flat disk shaped rim, 8, as in FIG. 4. A multiplicity of holes, 11, are located in the annular portion of the rim, through which the fluid flows upon discharging from the inverted bottle. The outer circumference, 16, of the rim is affixed to the inside wall of the bottle neck. FIG. 5 is a section through the bottle.

Figure 6:
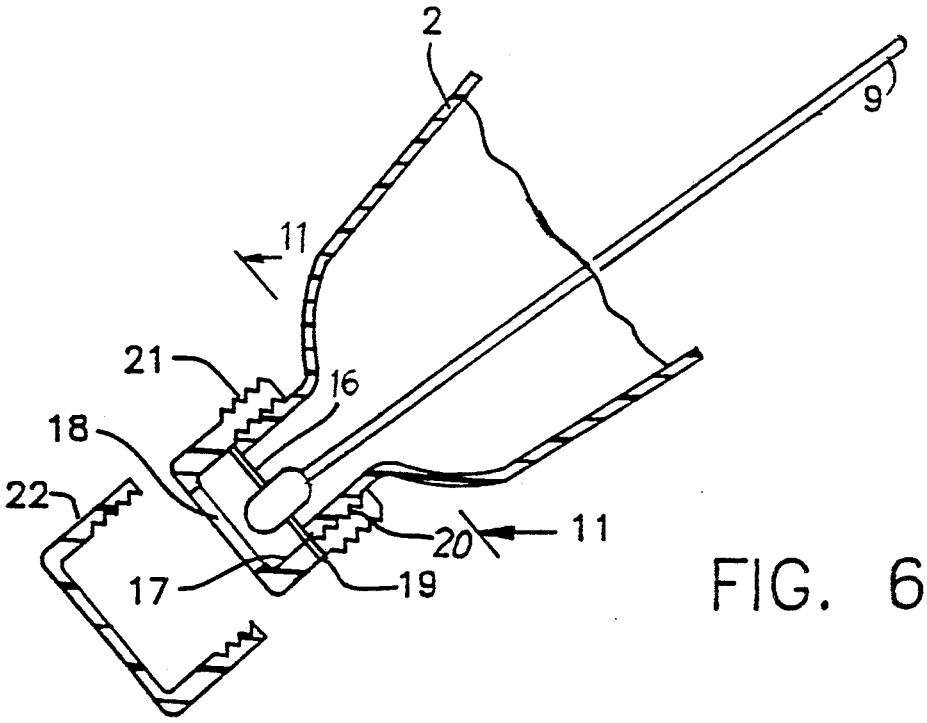
FIG. 6 is a section of the bottle flow controller, showing the rim attached to an open topped cap, together with a second cap.
Figure 7:
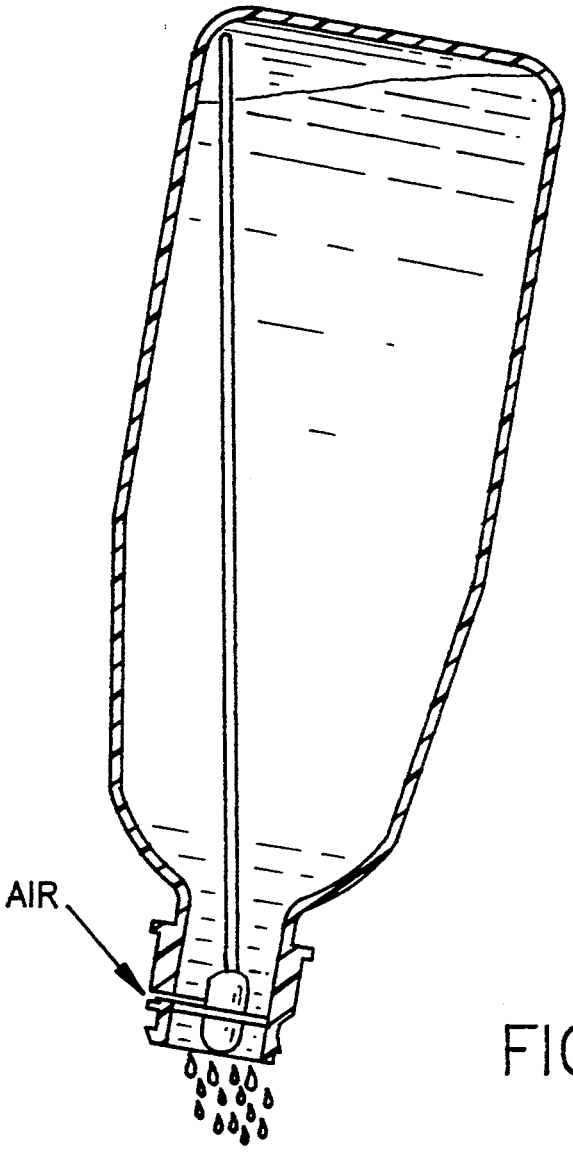
FIG. 7 is a cross-section of an open bottle in an inverted position, containing the bottle flow controller, with a small amount of fluid discharged from the bottle.
Figure 9:
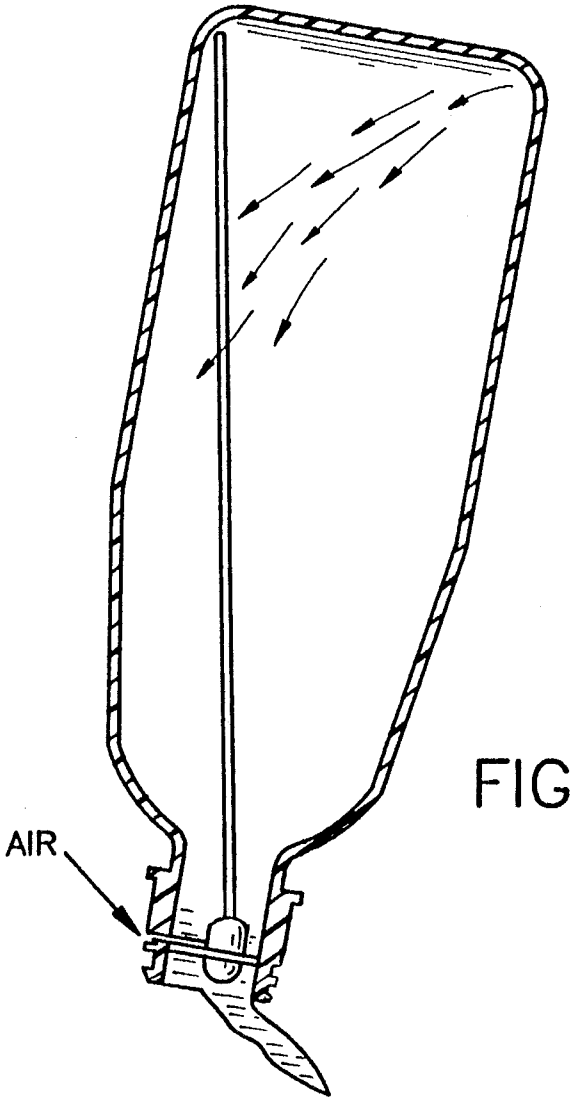
FIG. 9 is a cross-section of an open bottle in an inverted position, containing the bottle flow controller, with most of the fluid discharged from the bottle.
Figure 8:
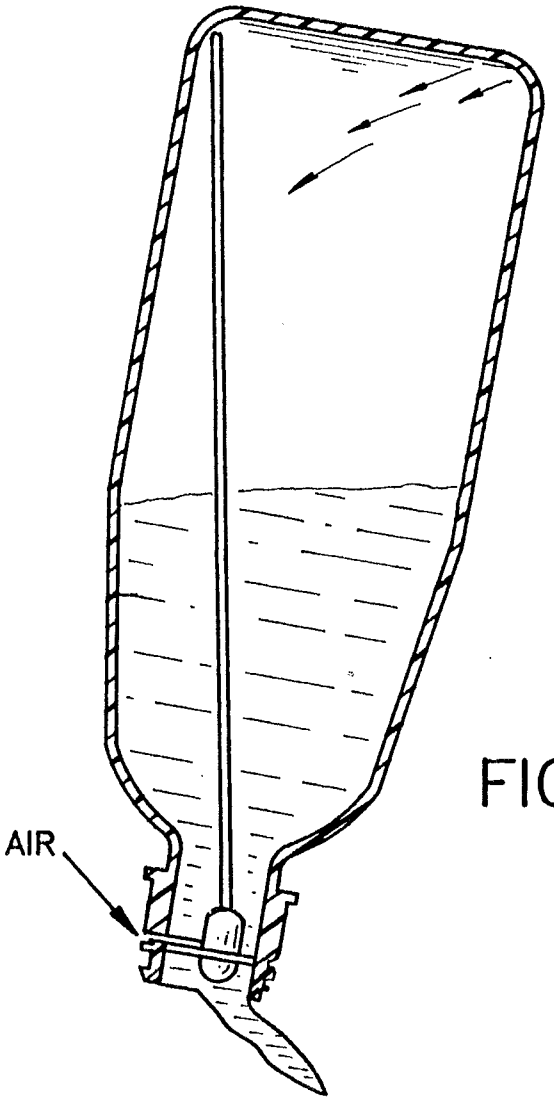
FIG. 8 is a cross-section of an open bottle in an inverted position, containing the bottle flow controller, with approximately half of the fluid discharged from the bottle.

In another embodiment of the invention, as in FIG. 6, the outer circumference of the rim, 16, is attached to the inner wall of a cap, 17, which is open on its top, 18, and in which an air inlet hole, 19, is located in its side. The inside of the bottom of the cap is threaded, 20, such that it can be screwed onto the open end of a bottle. The top outside of the cap, 21, is threaded such that a cap, 22, can be screwed on to close the bottle.

Figure 11:
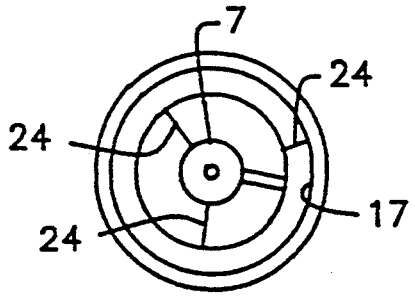
FIG. 11 is a top view of the top of a bottle sealed with a cap held by 3 supports.
Figure 12:
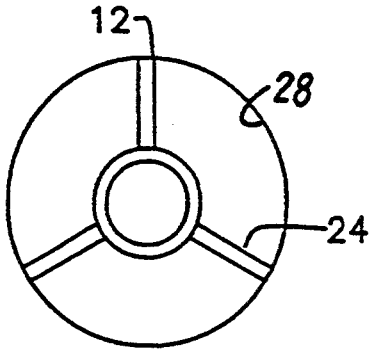
FIG. 12 is a top view of the tube-reservoir assembly.

In other embodiments, as in FIG. 11, the reservoir, 7, may be supported by three supports, 24, which are attached to the inner surface of the cap, 17, or , as in FIG. 12, to the inner surface, 28, of the neck of the bottle.

Figure 2:
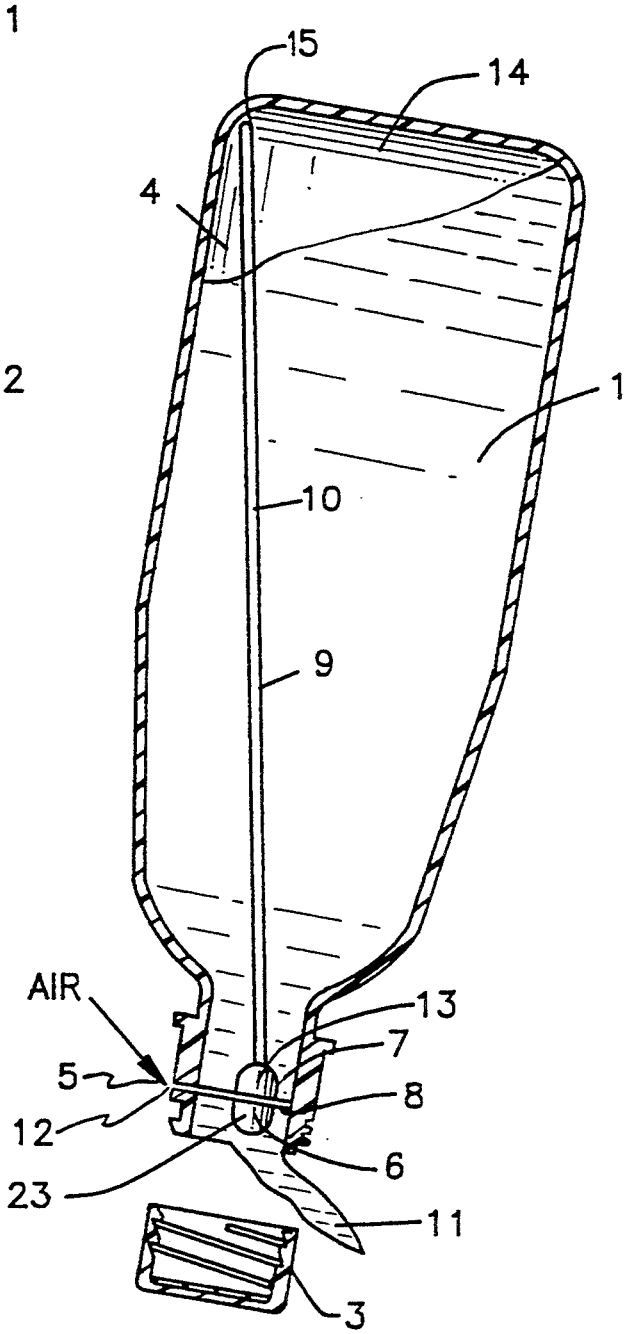
FIG. 2 is a cross-section of an open bottle in an inverted position, containing the bottle flow controller.
Figure 3:
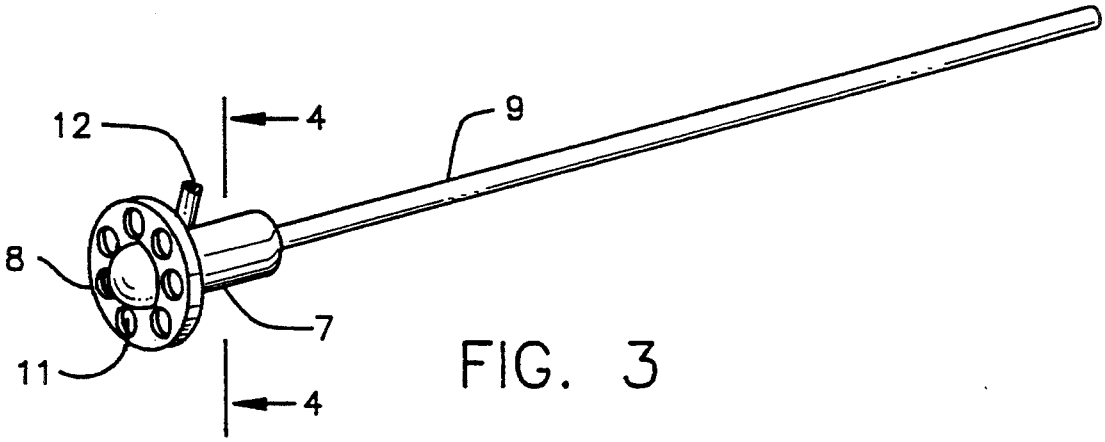
FIG. 3 is a perspective view of the bottle flow controller, without a surrounding bottle.

As seen in FIG. 2, as a result of the displacement of fluid from the bottle, a partial vacuum is created in the air cavity above the fluid, 4. Air, 5, is forced into the air inlet hole, 12, and flows through the unfilled end of the reservoir, 13, of the reservoir, 7. The air then flows, 10, up the tube, 9, to the air cavity above the fluid, 4. This air creates a pressure on the top of the fluid, 14. The tube, 9, is affixed to the end of the reservoir, 7, at an angle, such that when the bottle is inverted, the open end of the tube, 15, is located at the corner which contains air, 14, thereby allowing the air from outside the bottle, 5, to combine with the air in the corner, 14. Thus, none of the liquid can flow out of the bottle through the tube, 9. Only the small amount of the liquid which had already been within the tube when it was standing upright will now flow down to the top of the reservoir, 23, and remain there, below the level of the air inlet tube, 12, allowing a free passage for incoming air.

The top of the reservoir, 23, retains a small amount of liquid which is kept from leaking through the inlet hole, 12. The top of the reservoir, 23, is large enough to contain the entire amount of the liquid which had been located in the tube, 9.

The lower part of the reservoir, 13, should be as large as the top part of the reservoir, 23, in order to contain the full amount of liquid which will flow into it when flow is stopped, due to stoppage of drinking and holding the container upright. The liquid which was contained in the top part of the reservoir, 23, will not leak outside the bottle through the air tube, 12, but rather will be contained in the bottom part of the reservoir, 13, and then slowly continue flowing down through the tube, 9, to the bottom of the bottle. The top, 23, and the lower part, 13, of the reservoir need be of equal size. This is accomplished by placing the air inlet hole, 12, in the exact middle of the reservoir, 7. The present invention results in a steady strong fluid flow from a narrow necked inverted bottle, without a resulting gurgling and intermittent flow.

Figure 10:
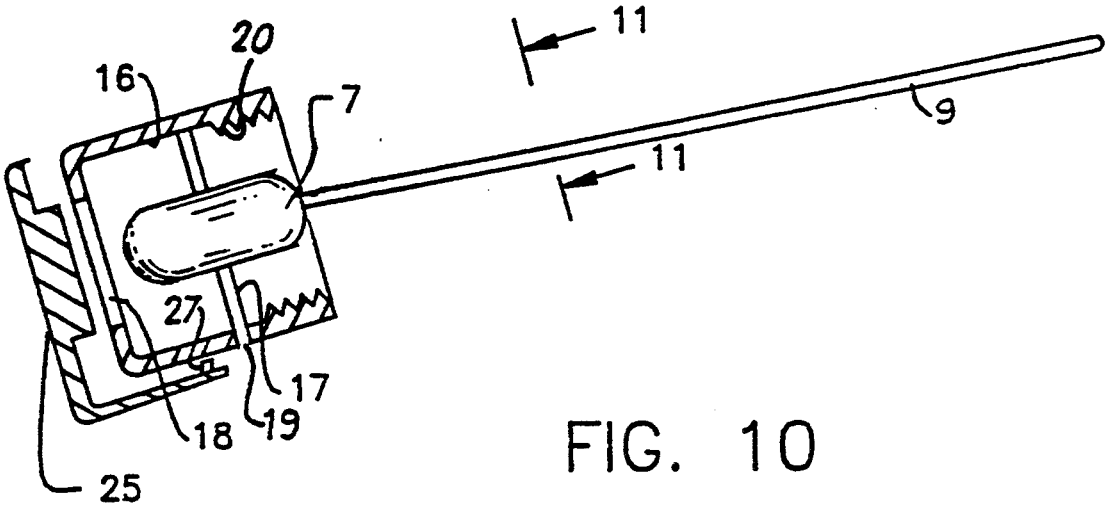
FIG. 10 is a cross-section of a tube-reservoir assembly which is affixed to a cap, showing another cap for sealing the opening in the top of the first cap.
Figure 13:
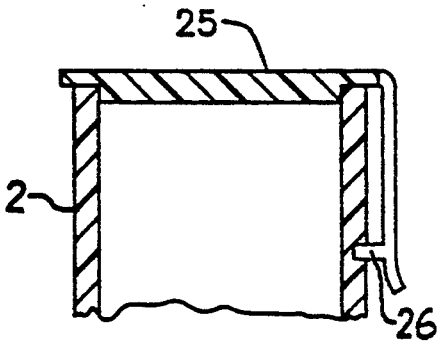
FIG. 13 is a cross section showing a cap for sealing the top of the bottle.

As shown in FIG. 10, an assembly consisting of the reservoir, 7, and tube, 9, may be attached, 17, to the inner walls of a cap, 16, which is open at the top, 18. The lower inner walls of the cap are threaded, 20, and affixed to a narrow necked bottle, which is threaded at the top. An outer cap, 22, is threaded over the cap, 21, as in FIG. 6. The outer cap, 25, may snap in place as in FIG. 10, which covers the air inlet tube, 19, via a tab, As shown in FIG. 13, a plastic cap, 25, with a tab, 26, may be used to seal the opening at the top of the bottle, 2.

What I claim is:

1. A bottle fluid flow controller for causing a steady discharge of fluid from an inverted narrow necked bottle comprising:

(a) a bottle having a narrow necked opening with a small hole in its neck and outside threads on the upper neck;

(b) a disk like retainer rim having a center hole and a multiplicity of holes through an annular section, the outer circumference of which is affixed to the inner wall of the narrow neck of the bottle;

(c) a hollow barrel-like reservoir having a hole at its upper end when in the inverted position and a hole in its side, the outer longitudinal surface being affixed to the inner circumference of the center hole of the retainer rim;

(d) an air inlet tube, perpendicular to the axis of the reservoir, with one end inserted into the side hole of the reservoir, the other end of which is extended through the side hole in the neck of the bottle;

(e) a tube axially and angularly inserted into the hole in the upper end of the reservoir and extending to the top and side of the bottle when in the inverted position.

* * * * *